United States Patent [19]

Jones

[11] 3,977,230

[45] Aug. 31, 1976

[54] APPARATUS FOR REPAIRING INDENTIONS IN A RIGID SKIN

[76] Inventor: Noel C. Jones, 422 S. 13th St., Frederick, Okla. 73542

[22] Filed: June 20, 1974

[21] Appl. No.: 481,168

[52] U.S. Cl. ..... 72/461; 72/391; 72/409; 72/457; 72/479; 72/705

[51] Int. Cl.[2] ..... B21D 1/12; B21D 11/20

[58] Field of Search ..... 72/457–461, 72/476, 479, 705, 409, 391; 81/302; 29/268

[56] References Cited

UNITED STATES PATENTS

| | | | |
|---|---|---|---|
| 2,424,752 | 7/1947 | Heermans | 29/268 UX |
| 2,605,658 | 8/1952 | Sanchez | 72/705 X |
| 2,949,144 | 8/1960 | Dredske et al. | 72/705 X |
| 3,066,719 | 12/1962 | Selnick | 72/705 X |
| 3,180,128 | 4/1965 | Faulkner | 72/461 X |
| 3,187,538 | 6/1965 | Painter | 72/705 X |
| 3,635,072 | 1/1972 | Steinmann, Jr. | 72/705 X |
| 3,677,129 | 7/1972 | Lyon | 81/302 |
| 3,823,462 | 7/1974 | Kanda | 81/302 X |

*Primary Examiner*—C.W. Lanham
*Assistant Examiner*—D. M. Gurley
*Attorney, Agent, or Firm*—Dunlap, Codding & McCarthy

[57] ABSTRACT

An improved apparatus for repairing indentions in a rigid skin, the apparatus comprising frame means supportingly holding backup means positioned to rest on a portion of the skin in close proximity to the indention, chuck means slidingly supported by the frame means to grippingly hold and movably position a dent engaging member contacting the indented portion of the skin. Retract means move the chuck means in a direction to pull the dented skin towards the backup means. In the preferred embodiment, the backup means comprise an apertured base plate contoured to matingly match the contour of the rigid skin in close proximity to the indention, a portion of the dentengaging member clearingly extending through the aperture.

2 Claims, 6 Drawing Figures

APPARATUS FOR REPAIRING INDENTIONS IN A RIGID SKIN

BACKGROUND OF THE INVENTION

1. Field of the Invention

The present invention relates to improved apparatus for repairing indentions in a rigid skin, and more particularly, but not by way of limitation, to an improved apparatus for repairing dents in the metal skin of the body of an automobile.

2. Description of the Prior Art

In the construction of vehicles and the like, an outer facade or skin surface often forms a body so as to enclose the operative parts of the vehicle, and to function as the outer skin in the wind stream created while the vehicle is moving. Examples of such vehicles are automobiles, trucks, travel trailers and airplanes. In the use of such vehicles and the like, the outer skin may be exposed to accidental damage brought about by normal usage in traffic, and may incur damage from weather elements, including hail, snow and rain. These are examples of the abuse generally created by external forces brought against the skin surfaces of vehicles and the like. As a result thereof, it often happens that indentations, or dents, are caused in the facade or skin surfaces, and it is often necessary or desirable to restore the skin surfaces to their original shapes.

Repair to outer skin surfaces, such as automobile body surfaces, is performed by a number of techniques. If damage is very extensive, it may be necessary to remove part of the outer skin, such as for example a fender, and to replace the removed part with a new or rebuilt component. If the body skin is dented, the dented area may be built up by adding material to fill in the dent, followed by surfacing finishing techniques to match the appearance of the repaired areas with the appearance of the surrounding surfaces. Yet another way of repairing dents in body skin surfaces is to force the dented area back to its original shape, or at least to approximately its original shape, by applying a force against the dented area in a direction generally opposite to the direction of impression of the dent.

It is a relatively easy matter to repair dented portions of a body skin when it is possible to have relatively free access to the back or dent protrusion side of the body skin. However, it is a different matter when the body skin is constructed in a manner so as to enclose a space wherein it is impracticable to work the rear side of the body skin. In this case, techniques have been worked out to pull the dent from the side of impression by attaching a pulling member to the area of indentation, such as by the use of a welding rod or the like. Several prior art patents that teach apparatus practicing this technique of dent straightening are U.S. Pat. No. 3,545,250, issued to Jones; U.S. Pat. No. 3,187,538, issued to Painter; U.S. Pat. No. 3,091,983, issued to Kliss; U.S. Pat. No. 2,799,190 issued to Awot; U.S. Pat. No. 2,957,376, issued to Parisi; U.S. Pat. No. 2,749,795 issued to Boykin, Jr.; and U.S. Pat. No. 674,133 issued to Cathriner.

While the prior art has generally met with success in repairing indentations in the body skin of automobiles and the like, usually the machinery or apparatus to perform the same has been bulky, or at best, rather awkward to manipulate. This is especially true when a vehicle has a large number of indentations, such as when an automobile has suffered the effects of multiple indentations caused by the striking thereof by falling ice or hail. Not only must a large number of impressions or dents be straightened, it is generally to be expected that the body skin is covered by paint or by a vinyl covering, such as in vinyl-topped automobiles, in which case it is undesirable to mar the surface as is generally required by most prior art devices.

Yet another problem with the straightening of dents is that of overpulling the indented portion wherein there is caused a positive protrusion after pulling the dent back to the surface. In other words, the metal skin forming the dented portion is plastically deformed so that it is not returned to its exact shape. Rather, the dented area will protrude from its original position, necessitating followup surface working to match the surface finish of the undented portion of the body skin.

SUMMARY OF THE INVENTION

The present invention provides an improved apparatus for straightening an indentation in a metal skin or the like wherein a dent-engaging member is placed in contact engagement with the dent, and a frame means, backup means, chuck means and retracting means cooperatively pull the dent-engaging member so as to force the indented portion of the body skin back to its original shape.

Accordingly, an object of the present invention is to provide an improved dent-straightening apparatus that easily and quickly attaches to and removes the dent.

Another object of the present invention is to provide an improved dent-straightening apparatus that is easily and quickly removed from the dented portion after straightening the dent.

Another object of the present invention is to provide an improved dent-straightening apparatus that minimizes the marring of the dented area while straightening.

Another object of the present invention is to provide an improved dent-straightening apparatus that prevents overpull of the dented area.

Another object of the present invention is to provide an improved dent-straightening apparatus that operates efficiently, minimizing the time and effort required to repair a body skin having one or many dents.

Another object of the present invention is to provide an improved dent-straightening apparatus that offers ease of manufacture, having a minimum of parts, thereby minimizing fabrication costs.

Another object of the present invention is to provide an improved dent-straightening apparatus that offers economy of operation.

Other objects and advantages of the invention will be evident from the following detailed description when read in conjunction with the accompanying drawings which illustrate various embodiments of the invention.

DESCRIPTION OF THE PREFERRED EMBODIMENT

Figure 1:
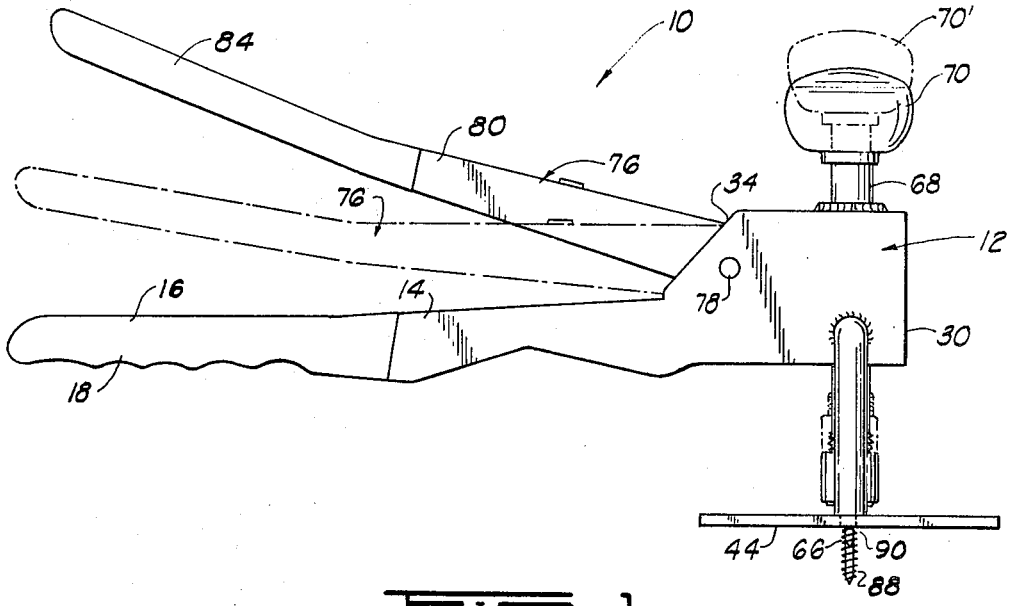
FIG. 1 is a side elevational view of the improved dent-straightening apparatus of the present invention.
Figure 2:
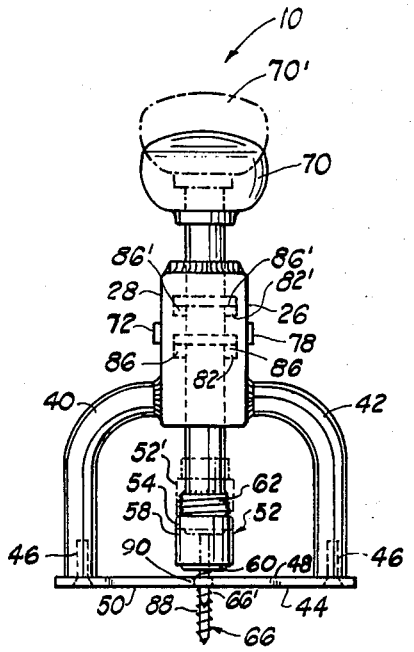
FIG. 2 is a front elevational view of the dent-straightening apparatus shown in FIG. 1.
Figure 3:
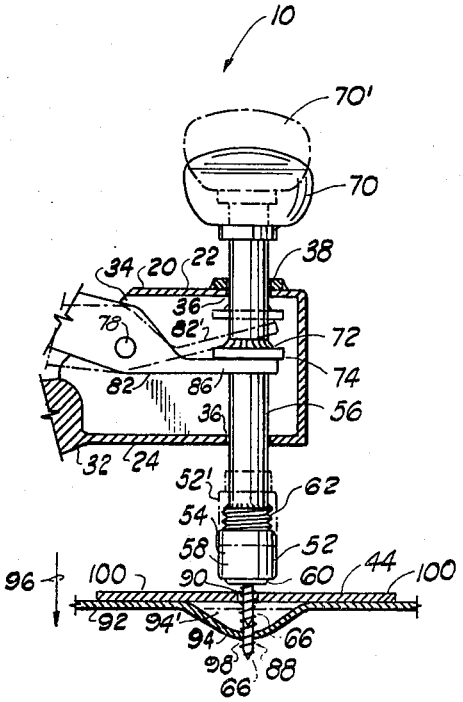
FIG. 3 is a cutaway depiction of the dent-straightening apparatus of FIG. 1 showing the operation of the lifting action of the handle member acting upon the peripheral flange of the chuck assembly.

Referring to the drawings, and particularly to FIGS. 1 through 3, the improved dent-straightening apparatus of the present invention is illustrated and generally designated by the numeral 10. The apparatus 10 basically comprises a frame member 12 that has a stationary handle member 14 extending therefrom. As appearing in FIG. 1, the handle 14 has a shaped gripping portion 16 having a finger contoured edge 18 along the underside thereof.

The frame member 12 further comprises, as shown in cut-away in FIG. 3, a box-like structure 20 having a top 22 and a bottom 24 and side walls 26 and 28. The front of the structure 20 is enclosed with the wall 30. The stationary handle 14 is welded to the box-like structure at 32, and an opening 34 is left between the adjoining point 32 and the top 22 of the box 12.

As best viewed in FIG. 3, a pair of apertures 36 are positioned in the top 22 and the bottom 24 in an inline relationship for the passing therethrough of a slide rod, the details of which will be given below. While bearings may be disposed within or about the apertures 36, it has been found sufficient for the purpose of the apparatus 10 to provide a reinforcing guide bead 38 on the top 22 and about the aperture 36 that passes through the top 22.

Connected to and extending from the wall 28 is a support member 40, and in like manner, connected to and extending from the wall 26 is a support member 42. The support members 40 and 42 curve out from the walls 28 and 26 and downward to support a base plate 44 that is connected to the support members 40 and 42 by attaching means such as by the screws 46 that are shown in dashed-line form in FIG. 2. Of course, if the screws 46 are used, appropriately spaced apertures in the base plate 44 and matching, threaded apertures must be disposed in the ends of the support members 40 and 42 for receiving the screws. In practice, it has been found that a variety of shapes for the base plate 44 are useful for straightening dents in contoured body skins, as will be made clear below, and this makes necessary a variety of attaching means be used for connecting variously shaped base plates to the support members 40 and 42. For example, the support members 40 and 42 may be made hollow, and extending stub inserts may be attached to the upper surface 48 of the base plate 44. Such inserts then together with the hollow cores of the support members 40 and 42 form a plug and socket, or male and female arrangement whereby the base plate 44 may be connected to the support members 40 and 42, in which case set screws or the like may be disposed at appropriate locations to firmly retain the inserts in the hollow core of the supports 40 and 42.

It has been found generally desirable to have the underside 50 of the base plate 44 smooth, and any attaching means used to connect the base plate 44 to the support members 40 and 42 should do so in a manner that does not affect the smoothness of the surface 50. For instance, the screws 46 are selected as tapered head screws, and the apertures through which they pass in the base plate 44 are appropriately tapered to receive the screw heads flush with the surface 50.

Slidingly disposed in the apertures 36 is a chuck assembly 52 comprising a vise chuck 54 and a slide rod 56. The vise chuck 54 is of conventional design, and need not be described in detail for purposes of this disclosure. It is sufficient to state that the vise chuck 54 has an outer sleeve 58 and gripping jaws 60 disposed at one end thereof. At the other end of the housing 58 is a threaded aperture with receiving threads that matingly engage a threaded portion 62 at the lower end of the slide rod 56. In known manner, as the housing 58 is tightened onto the threads 62, the jaws 60 are caused to grip uniformly about the shank of a member placed therein, such as that of the threaded engaging member 66, which will be described in more detail below. Chucks such as the vise chuck 54 may be found in such usages as electric drills, cabinetry drills, etc.

At the upper end 68 of the slide rod 56, a knob 70 is connected to the slide rod. The knob 70 is sized and shaped to generally fit the hand of an individual for manual rotating of the slide rod 56 in the apertures 36. Also attached to the slide rod 56, and intermediate to the knob end 68 and the threaded end of rod 56 is a peripheral flange 72 that is shaped to have a smooth under surface 74.

Extending through the opening 34 and the box structure 20 is the handle member 76 that is pivotally supported on the frame 12 by means of a pivot pin 78 that passes through an appropriately placed aperture in the handle member 76 and oppositely placed, aligning apertures in the side walls 26 and 28 of the frame 12. The pin 78 serves as an arbor for rotation of the handle 76 thereabout, and the pin is retained by staking means or the like in its position through the appropriate apertures.

The handle member 76 serves as part of a retracting means, as will become clear below, and comprises an extending portion 80 extending in one direction from the pivot point 78, and a forked portion 82 extending in the opposite direction therefrom. The extending portion 80 has a gripping portion 84 that is used in cooperation with the gripping portion 16 of the stationary handle 14, forming manually operated retracting means for the embodiment of the apparatus 10 shown in FIGS. 1 through 3.

The forked end 82 of the handle 76 comprises a pair of tines 86 that are spaced apart sufficiently to clear the slide rod 56 while liftingly contacting the undersurface 74 of the peripheral flange 72.

The engaging member 66 as will be made clear below, may comprise a variety of sizes and shapes, one of which is shown in FIGS. 1 through 3 wherein is shown an engaging member 66 having a threaded dent-contacting portion 88, and although not viewable in the figures, a shank portion opposite to the threaded end 88 that is gripped by the jaws 60 as described above. The engaging member 66 is a disposable portion of the apparatus 10, and in practice, it has been found that varying shapes and sizes of engaging members are desirable for various surfaces to be repaired. For example, it has been found that in some applications it is desirable to use an engaging member that has a shank portion for gripping, and a hook member instead of the threaded portion 88 shown for the engaging member 66 illustrated in the FIGS. 1 through 3. In any event, the engaging member 66 is gripped by the chuck assembly 52 for selective reciprocating movement relative to the base plate 44 that has a relief aperture 90 appropriately placed for the clearing passage therethrough of the engaging member 66.

OPERATION OF THE PREFERRED EMBODIMENT

The operation of the improved dent-straightening apparatus 10 as illustrated and described in FIGS. 1 through 3 will now be discussed. In brief summary, the improved dent-straightening apparatus 10 comprises frame means 12, backup means or base plate 44, chuck means or assembly 52 and retracting means 76 and 16, which elements cooperate to position and reciprocatingly move an engaging means 66. As described for the illustration of the embodiment 10 in FIGS. 1 through 3, the gripping portions 16 and 84 of the stationary handle 14 and the pivotable handle 76 are manually manipulated to raise the chuck assembly 52. This description will have further clarity by the use of the dashed outlines of the moving components of the apparatus 10 in the figures, and these dashed outlines will be given primed numeral designations to aid in clearly understanding the operation of apparatus 10.

When the handle 76 is in the position designated 76', the forked portion 82 is cuased to pivot to the position designated 82', and the tines 86, designated as 86' in the corresponding position, are caused to act against the underside 74 of the peripheral flange 72, and to raise the peripheral flange to a position designated 72'. Of course, this results in the raising of all of the components of chuck assembly 52 to the position designated 52', resulting in the raising of the engaging member 66 to a position designated as 66'.

Now to describe the operation of the apparatus 10 in its utility purpose, it will be necessary to discuss the operation relative to a body skin 92 shown in cross section in FIG. 3, and having a dent 94 impressed therein. It will be understood that the dent 94 was formed by a force applied in an impressing direction 96 against the body skin 92, resulting in the indentation 94.

The operator of the apparatus 10 is instructed to place the handle member 76 in the up position as shown in the FIG. 1, and to place the base plate 44 onto the body skin 92 so that the aperture 90 in the base plate 44 generally is over the center 98 of the dent 94. It is noted that the base plate 44 is sized so as to span a larger area than the dent 94, such that a portion 100 of the base plate 44 is supported on the body skin area 92 that is in close proximity and generally about the dent 94. While the size of the plate 44 is conveniently shown relative to a small dent 94, it will be understood that the plate 44 may be sized as necessary in order that a portion of the plate is supported on an unmarred portion of the body skin 92.

The next step for the operator of apparatus 10, having placed the apparatus as instructed above, is to manually push the chuck assembly 52 downwardly in the direction 96 by pushing on the knob 70. This action causes the engaging member 66, which has been placed into the vise chuck 54 as described in the description of the construction above, into contact with the center 98 of the dent 94. The threaded portion 88 has a self-tapping thread for threaded engagement with the dent 94. In some applications, such as when working to straighten dents in automobile bodies, it has been found desirable to place a small hole through the dent 94 at its center 98 to assist in starting the threaded portion 88 therethrough. While desirable, this has not been found to be essential to the use of apparatus 10. Once the threaded portion 88 is placed in contact with the center 98 of dent 94, the knob 70 is manually turned while applying a downward and rotating movement to the knob 70. This engages the threaded portion 88 of engaging member 66 through the center 98 of dent 94. This downward screw force is continued until the engaging member 66 is in secure engagement with dented portion 90 of body skin 92; the object here being to have the engaging member capable of pulling firmly on the dent 90.

To straighten the dent 94, the operator now merely squeezes the gripping portions 16 and 84 together, causing the downward movement of the handle 76 to the position 76'. This in turn causes the raising of the peripheral flange 72 by the action of the forked portion 82 of handle 76, which in turn pulls the engaging member 66 toward the base plate 44. The threaded engagement of the engaging member 66 with the dent 94 causes the upward movement of the chuck assembly 52 to apply a force to the dent 94 in a direction generally opposite to the impressing direction 96, and raises the dented portion up to and forced against the base plate 44. The length of each of the handles 14 and 76 is determined so as to provide a large mechanical advantage in forcing the chuck assembly 52 to move upward against the restraining force offered by the material forces of the dent.

It will be clear that detaching the apparatus 10 from the dent 94 is effected by reverse turning of the knob 70 so that the threaded portion 88 is released from the area that previously formed the dent, this area being at this time in the position designated 94'. Once released, the dent-straightening apparatus 10 is free to be used in the same manner as described to straighten another dent.

The result of raising the dent 94 to its previous position, (34') is that the dent 94 has been repaired, and the only remaining disturbance to the body skin 92 is the hole which was placed into the center 98 of the dent 94. In some applications, this hole is sufficiently small that it simply does not show. In other applications, it will be necessary to fill in this small hole by known surface repair techniques and procedures. In any event, further damage to the body skin 92 has been minimized to effectuate the repair, which has been made quickly and without a resulting overpull of the dented portion 94. That is, the base plate 44 has served as backup means against which the dented portion 94 is forced to provide a level repair surface, the base plate serving both to mold the dented portion and to prevent the chuck assembly 52 from overpulling the dent.

Figure 4:
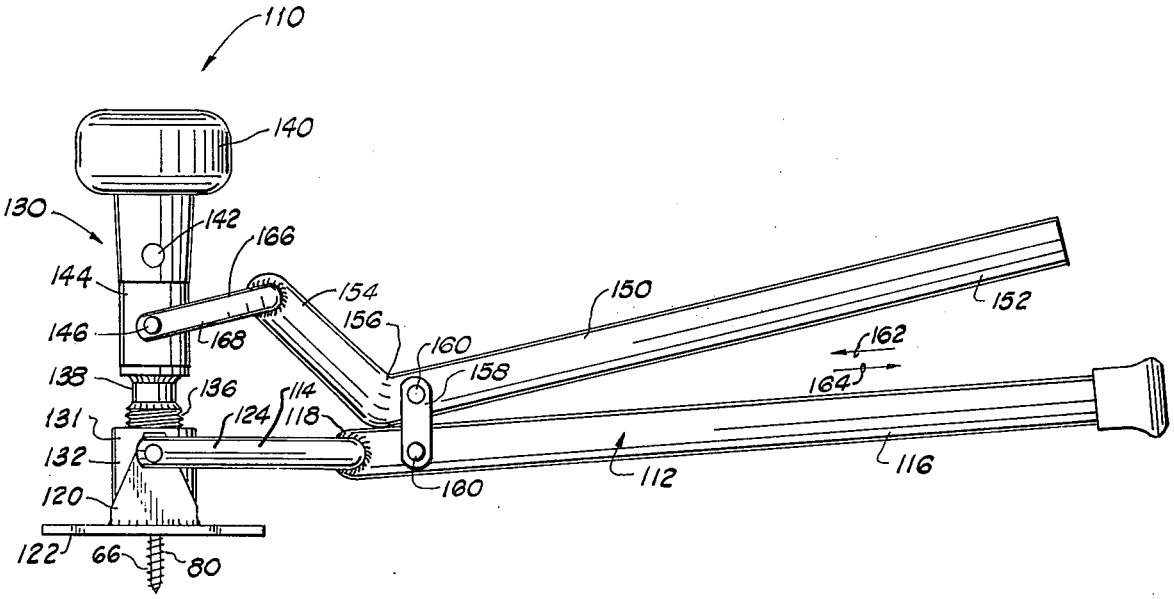
FIG. 4 is a side elevational view of another embodiment of the improved dent-straightening apparatus of the present invention.
Figure 5:
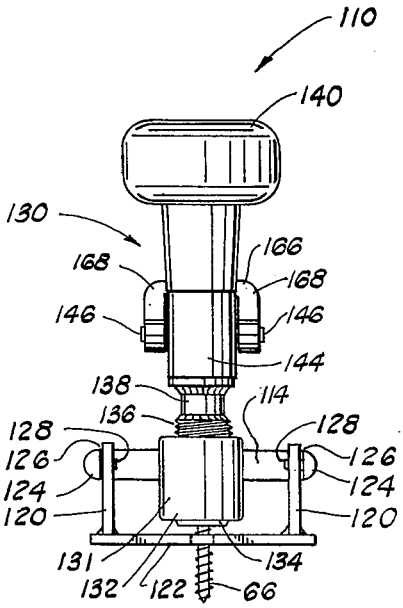
FIG. 5 is a front elevational view of the dent-straightening apparatus of FIG. 4.
Figure 6:
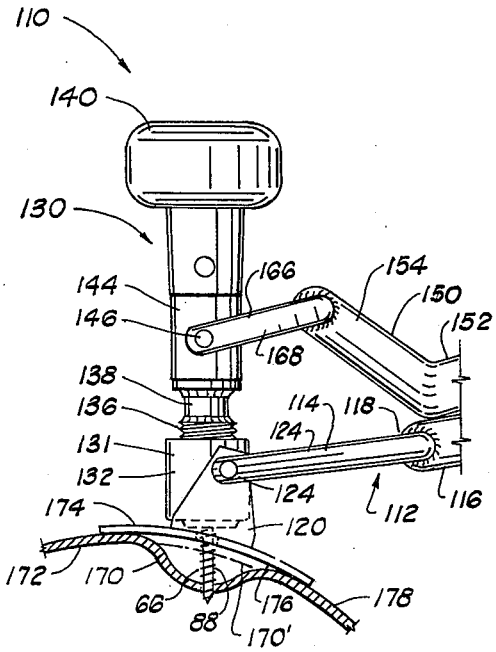
FIG. 6 is a view of the dent-straightening apparatus of FIG. 4 in contacting engagement with a dent, illustrating the positioning of the dent-straightening apparatus along a curved body skin surface.

Description of the Embodiment of FIGS. 4 through 6

Referring to FIGS. 4 through 6, shown therein is another embodiment of the improved dent-straightening apparatus of the present invention, generally designated by the numeral 110. The apparatus 110 comprises the elements described above for the embodiment 10, but in somewhat varying arrangement.

The apparatus 10 comprises as its frame means the handle frame 112 which includes a yoke 114 and a first handle member 116 connected to the base 118 of the yoke 114. The yoke 114 is connected to a pair of plates 120 that are welded to extend normal from a base plate 122. Each of the tines 124 of yoke 114 is made of one-half round stock having a flat inner surface 126 that is positioned adjacent to the respective plate 120, and extending stub rod 128 extends from each of the surfaces 126. Appropriately placed apertures toward the top of the plates 120 receive the rods 128 such that the rods are pivotable therein. This arrangement provides a pivotal connection between the yoke 114 of the handle frame means 112 with the base plate 122. For base plate removal purposes, the plates 120 may be made resilient to the degree that the plates 120 may be removed from the stub rods 128, and different shaped base plates placed thereon, as will become clear below.

The apparatus 110 also comprises chuck assembly 130 which includes a vise chuck 130 which is of the same general construction as the vise chuck 54 described above. That is, the vise chuck 130 comprises a housing 132 and the chuck jaws 134. The end of the housing 132 opposite to the chuck jaws 134 contains a threaded bore that engages the threaded end 136 of the slide rod 138. At the other end of the slide rod 138, that is at its end opposite to the threaded end 136, a knob 140 is pressed thereover and staked in stationary relationship thereto by means of the set pin 142.

A barrel member 144 has a longitudinal bore therethrough (not shown) that rotatingly and slidingly supports the portion of the slide rod 138 between its threaded end 136 and the knob 140. Projecting from opposite sides of the barrel 144 and attached thereto are the protruding rods 146, the purpose of which will become clear below.

A second handle member 150 is also provided, as viewed in FIG. 4. The second handle member 150 has a gripping portion 152 and an angled portion 154. In close proximity to the joint 156 where the angle portion 154 is connected to the grip portion 152, a pair of links 158 are disposed on either side of the first and second handle members 116 and 152. Protruding from each side of the handle members is a pair of link pins 160 that are disposed through appropriately placed apertures in the links 158, the link pins being head staked so that the links are pivotally held onto the pins 160. This arrangement allows the pivoting of the second handle member 150 relative to the first handle member 116, as well as permitting the second handle member to move in the directions 162 and 164 relative to the first handle member 116. Of course, this movement is limited by the length of the links 158, which is determined to permit angular movement of the chuck assembly 130 relative to the base plate 122 as will be made clear below.

Attached to the second handle member 150 at the distal end of 154 opposite to the joint 156 is a second yoke member 166 disposed so as to be generally parallel to the gripping portion 152, although this is not essential to the operation of apparatus 110. The tines 168 are appropriately apertured to fit over the protruding rods 146 with sufficient clearance to be rotatable thereabout. The exterior ends of the protruding rods 146 are staked in a conventional manner to hold the tines 146 thereupon.

Shown in the FIGS. 4 through 6 is the engaging member 66, described above, held grippingly by the chuck jaws 134 of the vise chuck 131 in the same manner as above described for apparatus 10. The base plate 122 has a relief aperture through which the engaging member 66 clearingly passes.

Operation of the Embodiment of FIGS. 4 through 6

The operation of the improved dent-straightening apparatus 110 as illustrated and described in FIGS. 4 through 6 will now be discussed. In brief summary, the improved dent-straightening apparatus 110 comprises handle frame means 112, backup means or base plate 122, chuck means or assembly 130 and retracting means 150 and 116, which elements cooperate to position and reciprocatingly move an engaging means 66. As was described above for the embodiment 10 of FIGS. 1 through 3, the operation of the embodiment of FIGS. 4 through 6 is essentially the same. The first handle member 116 and the second handle member 150 are manually manipulated to raise the chuck assembly 130. The description for the previously discussed embodiment was aided by the use of dashed outlines of the moving components of apparatus 10, and since the operation of apparatus 110 will not be understood without the use of such dashed lines, these have been omitted from FIGS. 4 through 6. However, it will be understood that the moving components of apparatus 110 assume similar positions as described for the apparatus 10.

When the second handle member 150 is squeezed toward the first handle member 116, the second yoke member is caused to pivot away from the first yoke 114, being pivotable about the link means of the links 158 connected to the handle members. Of course, this movement forces the chuck assembly 130 in a movement away from the base plate 122.

The operation of the apparatus 110 in its utility purpose is the same as that of apparatus 10, discussed above. In order to avoid redundance, the operation of apparatus 110 will be described in its use to straighten a dent 170 in a contoured body skin 172, the object being to raise the dent portion 170 to assume a profile position of 170' which represents its position prior to the indentation.

For the purpose of discussing the operation of apparatus 110, the base plate 122 which was described in the discussion of the structure of apparatus 110 above has been replaced with a base plate 174. In order that the base plate 174 serve as backup means for the contour of body skin 172, it is usually desirable to use a contoured base plate 174 which is curved to have its under surface 176 matingly align with and rest upon the curved surface 178 of body skin 172. It is within the contemplation of the invention herein that a number of shaped base plates may be necessary for the utilization of the dent-straightening apparatus 10 or 110 for various curvatures of body skins that are to be repaired with the apparatus. To this end, the base plate has been designed to be readily removed and exchanged with a properly shaped base plate for any particular curvature of the body skin under repair. It should also be noted that the base plate was made stationary relative to the frame means of apparatus 10, while the base plate of apparatus 110 has been made to pivot relative to the frame means of apparatus 110. Depending upon the use of the dent-straightening embodiments taught herein, it may or may not be a desirable feature to have the base plate pivotable relative to the frame means. It will be understood that the base plate 44 of apparatus 10 may be made pivotable by an appropriately designed attachment fixture holding the base plate relative to the frame means, and that the base plates 122, 174 described for apparatus 110 may be made stationary relative to the frame means.

As was described for the operation of apparatus 10 above, the engaging member 66, having a threaded portion 88, is engaged with the dent 170 in the same manner as described above for apparatus 10. It will be understood that the dent removal results from squeezing the handle members 116 and 150 together to force the dent 170 against the curved base plate 174. However, there is some difference to the operation of 110 in that the engaging member 66 can be placed in a non-centered position relative to the dent 170, as is shown for illustration purposes in FIG. 6. That is, by moving the second handle member 150 in the directions 162, 164 relative to the first handle member 116, the chuck assembly 130 is tilted relative to the base plate 174. This permits the relative profile as shown for purposes of disclosure in FIG. 6. In some applications, it has been found that this is a desirable feature in that it permits irregularly shaped dents to be straightened by the apparatus 110. For example, the dent 170 may not raise in a uniform manner, but may have a wrinkled portion even after the bulk of the dent has been raised from its depressed profile. With the apparatus 110, this presents no particular difficulty as the engaging member 16 may be removed from the dent proper and reinserted into the recalcitrant non-raised portion of dent 170 for completion of the straightening thereof.

Thus, the present invention is well adapted to carry out the objects and obtain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In an apparatus for straightening a dent in a metal skin wherein a dent-engaging member having a shank and a dent contacting portion engagingly pulls the dent from a depressed profile, the improvement comprising:

a first yoke member having a pair of tines;

a first handle member connected to the first yoke member;

a base plate having a relief aperture therethrough, the tines of the first yoke member connected to the base plate at opposite sides thereof;

chuck means for gripping the shank of the dent-engaging member and for positioning the dent contacting portion for clearing movement through the base plate aperture;

a second yoke member having a pair of tines, the tines pivotally connected to the chuck means;

a second handle member connected to the second yoke member; and, link means for pivotally connecting the first and second handle members at one end each thereof whereby the pivotation of the first handle member relative to the second handle member moves the chuck means selectively towards or away from the base plate whereby movement of the second handle member relative to the first handle member selectively tilts the chuck means relative to the base plate.

2. The improvement of claim 1 wherein the chuck means comprises a vise chuck assembly rotatably held by the frame means in sliding relationship thereto, the shank of the dent engaging member grippingly held by the vise chuck assembly.

* * * * *